United States Patent [19]

Henrion

[11] 3,982,093

[45] Sept. 21, 1976

[54] THERMAL PRINTHEAD WITH DRIVERS

[75] Inventor: W. S. Henrion, Houston, Tex.

[73] Assignee: Texas Instruments Incorporated, Dallas, Tex.

[22] Filed: Dec. 16, 1974

[21] Appl. No.: 533,429

[52] U.S. Cl. ..... 219/216; 219/543; 346/76 R; 357/56

[51] Int. Cl.[2] ..... H05B 1/00

[58] Field of Search ..... 219/216, 543; 357/28, 357/56; 340/324 R; 346/76 R

[56] References Cited

UNITED STATES PATENTS 3,700,852 10/1972 Ruggiero ..... 219/216

*Primary Examiner*—C. L. Albritton

*Attorney, Agent, or Firm*—Hal Levine; Rene' E. Grossman; Leo N. Heiting

[57] ABSTRACT

An integrated semiconductor circuit has a portion thereof divided into a plurality of air isolated mesas which constitute a heater element array. A heater transistor formed within each mesa is selectively turned on in response to logic signals to heat one mesa of the array. By selectively heating the correct mesas, an area of the mesa array corresponding to a desired character is heated. Thermally sensitive material on which a dynamic display is formed or on which a permanent display is printed is in thermal contact with the material of the heater element array. Also formed within each mesa is its corresponding driver transistor.

7 Claims, 13 Drawing Figures

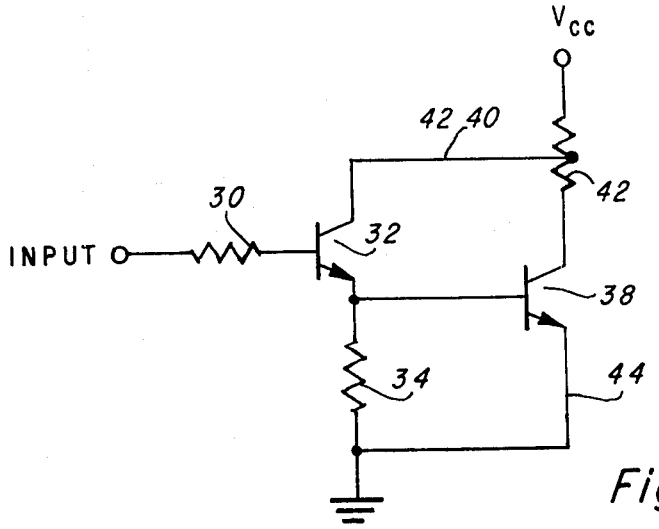
Fig. 3
Fig. 4
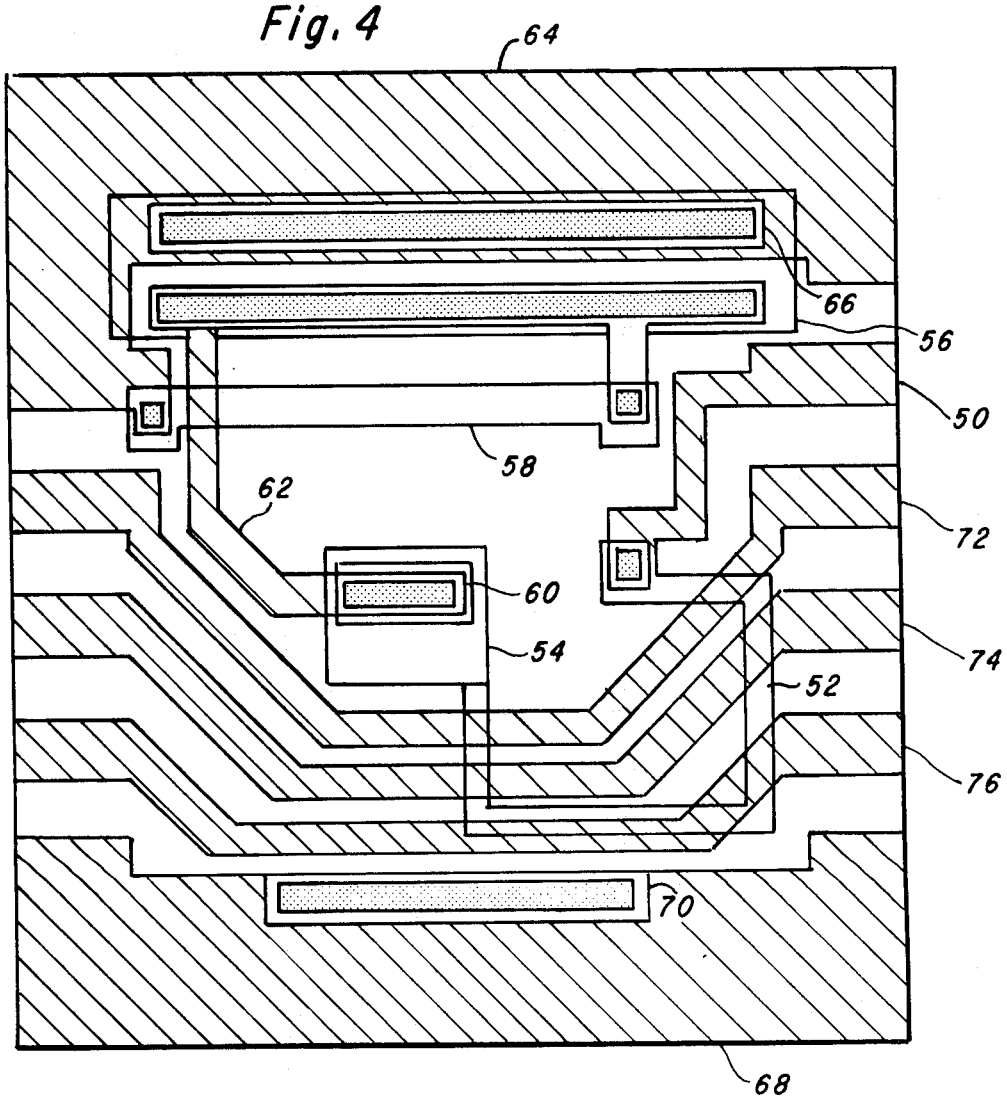

THERMAL PRINTHEAD WITH DRIVERS

The present invention relates to thermal displays of the type having an array of heater elements selectively energized to provide an information display on thermally sensitive material and more particularly to an integrated semiconductor heater element array wherein each heater element contains a driver as well as a heater transistor.

An integrated semiconductor heater element array and drive matrix are described in U.S. Pat. No. 3,601,669 to Merryman et al, assigned to the assignee of the present invention. A rectangular area of monocrystalline silicon semiconductor wafer is etched or otherwise operated on so as to produce a plurality of semiconductor mesas. The mesas are arranged along rows and columns in the rectangular area and have their tops coplanar of the silicon semiconductor wafer. A heater transistor is formed at the underside of each mesa so that when the heater element is energized, the mesa is heated thereby providing a localized dot on thermally sensitive material located above the semiconductor wafer. A group of selectively energized heater transistors forms a group of dots on the thermally sensitive material defining a character or information representation displayed on the thermally sensitive material.

Thermal display systems of the type just described are used in conjunction with logic circuitry which selects the proper mesas for heating in the formation of specific characters. The logic circuitry is frequently comprised of a plurality of TTL integrated circuits. In a typical thermal printhead, the base drive current required to turn on one of the heater transistors in the printhead is of the order of 3 to 5 milliamperes. Conventional TTL integrated circuits are incapable of providing drive currents at this level. Accordingly, it is customary to include a driver transistor at some point between the output of the TTL logic circuits and the input of each heater transistor.

In some cases, the driver transistors have been provided by one or more separate integrated circuits distinct from the TTL logic circuits and from the thermal printhead integrated circuit itself. This method of implementing the driver transistor function is undesirable since the addition of the driver transistor integrated circuits adds to the complexity and cost of the printhead system. A second practical difficulty with this approach stems from the fact that the driver transistor integrated circuits are special purpose devices and not readily available commercially.

A second way of providing the driver transistor function is that disclosed and claimed in the aforementioned U.S. Pat. No. 3,601,669. There the driver transistors and their associated resistive networks are fabricated on the same semiconductor wafer containing the thermal printhead matrix. The driver transistors and their resistive networks are located in a portion of the wafer distinct from that area wherein is located the thermal printhead matrix. There are several problems associated with this mode of implementing the driver transistor function.

One problem results from the fact that the thermally sensitive paper in most applications will be in contact with that portion of the semiconductor wafer wherein is located the driver transistor structure as well as that portion containing the thermal printhead matrix. As a result, spurious hot spots on the wafer face, caused by electrical energy dissipation in the driver transistors, may result in undesired registrations on the thermally sensitive paper. The prevention of these spurious hot spots requires tight quality control during the fabrication of the driver transistor portion of the semiconductor structure.

A second difficulty with this type of structure stems from the fact that the wafer area required for the driver transistor structure is at least as large as that required for the thermal printhead matrix. As a result, the amount of semiconductor material required for such printheads is considerably greater than that which would be required if the wafers comprised only the thermal printhead matrix.

A third problem with this type of structure relates to its fabrication costs. It is well known in the integrated circuit art that electrical isolation must be provided between the various elements of an integrated circuit. As described in the aforementioned U.S. Pat. No. 3,601,669, PN junction isolation may be used in the driver transistor area of the wafer. The special diffusions required to provide this type of isolation add to the fabrication costs of the thermal printhead structure.

The present invention provides a thermal printhead structure which is not subject to the problems associated with previously available printheads. In the printhead of the present invention, the driver transistor structure is fabricated as part of the thermal printhead matrix itself. Each mesa of the printhead matrix, in addition to its heater transistor, contains the corresponding driver transistor and resistive network. In this way the thermal printhead of the present invention eliminates the need, either for a separate integrated circuit containing the driver transistors, or for additional area on the semiconductor wafer to the side of the thermal printhead matrix to permit fabrication of the driver transistors. Further, any heat energy generated by the driver transistors occurs where it is most desired, that is, in the mesa itself. Finally, the air isolation between the mesas of the printhead matrix provides electrical as well as thermal isolation between the mesas. Accordingly, additional diffusion steps to provide electrical isolation are not required when the driver transistors are incorporated as part of the mesa structure.

It is therefore an object of the invention to provide a thermal printhead matrix, each element of which can be driven directly from the associated logic circuitry.

It is a further object of the invention to provide a thermal printhead matrix while minimizing the area of the semiconductor wafer required.

It is another object of the invention to provide a readily fabricated thermal printhead structure which does not produce spurious marks on the printed medium as a result of driver transistor heating.

Other objects and features of the invention will be understood by a consideration of the following detailed description in company with the attached drawings wherein:

FIGS. 1*a* and 1*b* illustrate a thermal printhead structure.

FIG. 3 is a schematic diagram of the driver transistor/heater transistor network of the invention.

FIG. 4 illustrates the electrical layout for a typical mesa.

Figure 6A:
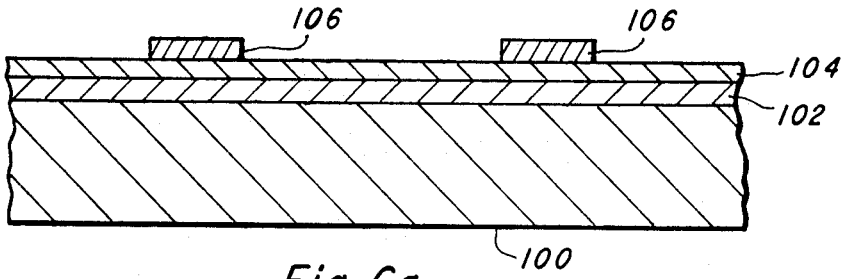
Figure 6B:
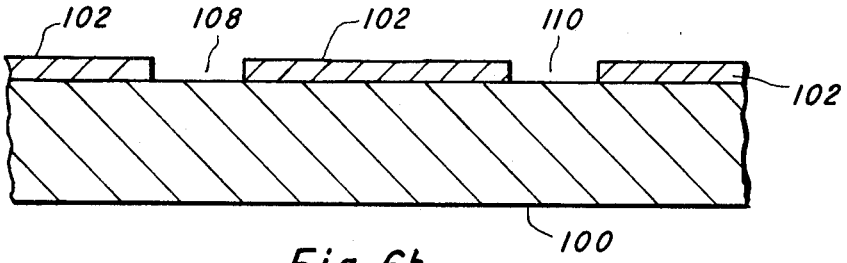

FIGS. 6*a*–6*b* illustrate the fabrication of a printhead.

Figure 1A:
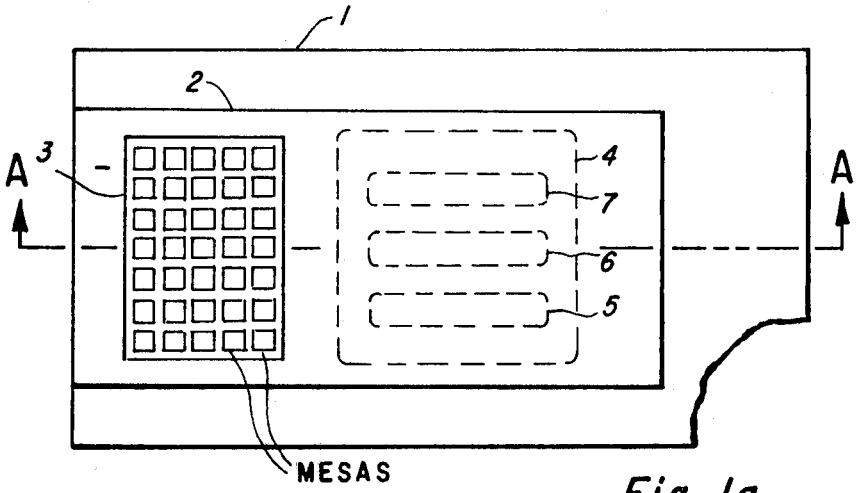
Figure 1B:
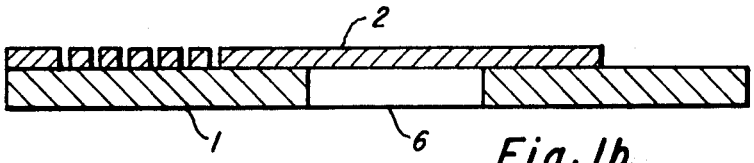

FIGS. 1*a* and 1*b* illustrate a prior art thermal printhead structure and are useful for introducing the detailed description of the invention. FIG. 1*a* illustrates a 5×7 heater element array of semiconductor mesas, located within the window 3, and the drive matrix 4 over which thermally sensitive material is positioned to form a dynamic information display of the type described in U.S. Pat. No. 3,323,341 by J. W. Blair et al in which the described thermochronic materials are used or over which is passed a specially treated thermally sensitive material to form a permanent information display or printer of the type described in U.S. Pat. No. 3,496,333 by Emmons et al. FIG. 1*a* is a plan view of the structure while FIG. 1*b* is a cross sectional view taken along line AA of FIG. 1*a*.

A monocrystalline silicon semiconductor wafer 2 is mounted on a larger insulating support 1, which may be any suitable material, for example, ceramic, glass or sapphire, by way of an insulating adhesive having good thermal and electrical insulating properties such as epoxy.

Each heater element of the array comprises a monocrystalline semiconductor body in a mesa shape and contains a heater element formed therein at the underside of the mesa adjacent the support 1, so that when the heater element is energized the mesa is heated to provide a localized dot on the thermally sensitive material above it. A group of selectively energized heater elements forms a group of dots on the thermal sensitive material defining a character or information representation displayed on the thermally sensitive material.

The mesas comprising the heater element array are air isolated from each other and joined by a metallic connecting pattern underneath the mesas between the semiconductor wafer 2 and the support 1 which pattern interconnects the heater elements in the mesas in the desired circuit configuration. The drive matrix for selectively energizing the heater elements and supplying the desired power to the heater elements is located in the semiconductor wafer 2 in the area generally designated as 4. The circuit elements forming the drive matrix are integral with the semiconductor wafer 2, PN junction isolated from one another and interconnected in the desired circuit configuration by a metallic connecting pattern underneath the wafer 2 between the wafer 2 and the support 1. The heating element array and the drive matrix are also interconnected in the desired circuit configuration by the metallic connecting pattern between the wafer 2 and the support 1.

The semiconductor wafer 2 is integral except within the window 3 in which are located the air isolated heater elements and consequently the top surface of the semiconductor wafer 2 presents a good, more uniform support for the positioning or passing of the thermally sensitive material over the heater element array.

The metallic connecting pattern located between the semiconductor wafer 2 and the support 1 extends out into bonding pads located above the openings 5, 6, and 7 in the support 1 so that external connection can be made to these bonding pads through the openings in the underside of support 1. The external connections are formed at the underside of support 1 and are removed from the thermally sensitive material located above the mesas. The metallic connecting pattern located between the semiconductor wafer 2 and the support 1 mechanically and electrically joins the air isolated mesas and electrically connects them to the circuit elements of the drive matrix and is supported in the epoxy adhesive resting between the semiconductor wafer 2 and the support 1.

Figure 2:
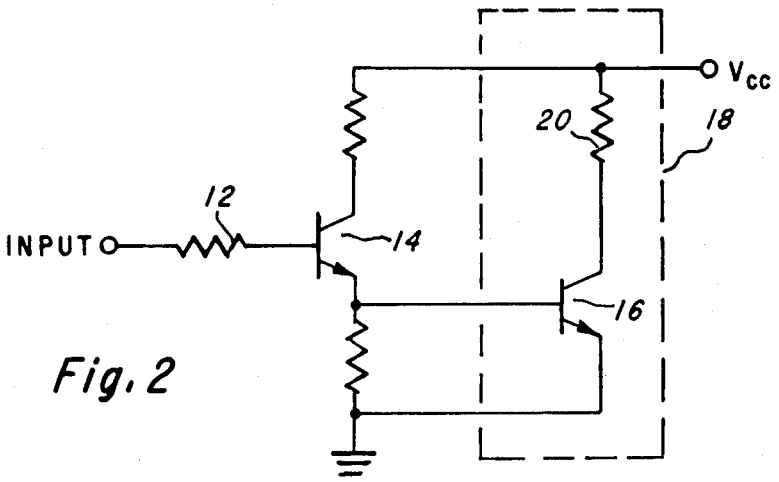
FIG. 2 is a schematic diagram of a known driver transistor/heater transistor network.

The schematic diagram of FIG. 2 illustrates prior art circuit elements comprising a driver transistor/heater transistor pair for one of the mesas of the printhead matrix. An input logic signal is coupled by resistor 12 to driver transistor 14. When the input logic signal switches to the high state, this turns on driver transistor 14 and the increased voltage level at its emitter turns on heater transistor 16. In the prior art structure only heater transistor 16 and its associated collector resistor 20 are located within the mesa itself, this being shown diagrammatically by dashed rectangle 18. When heater transistor 16 turns on, electrical energy dissipated within the transistor and its collector resistor 20 is converted to thermal energy in the mesa thereby causing a hot-spot at the surface thereof. Those elements of FIG. 2 not enclosed within rectangle 18 are located at the drive matrix, shown generally in region 4 of FIG. 1*a*. Electrical energy dissipated in the driver transistor and its associated resistors may cause a spurious hot-spot in an undesired region of semiconductor wafer 2.

FIG. 3 is a schematic diagram of the circuit elements implemented within each mesa in the preferred embodiment of the present invention. The input logic signal is coupled by resistor 30 to the base of driver transistor 32. The emitter of transistor 32 is coupled through resistor 34 to ground and also by line 36 to the base of heater transistor 38. The emitter of heater transistor 38 is coupled by line 44 to ground, and its collector is connected through load resistor 42 to the supply voltage $V_{CC}$. The collector of driver transistor 32 is coupled by line 40 to an intermediate point of resistor 42. In the preferred embodiment the resistance of resistor 30 is approximately 2K while that of resistor 34 is approximately 1K. It will be recognized by those skilled in the art that positive logic voltages appearing at the input of the circuit will turn on both driver transistor 32 and heater transistor 38, thereby generating a hot-spot at the surface of the mesa.

In FIG. 4 there is shown a portion of the semiconductor wafer used in the preferred embodiment of the invention. The portion of the wafer shown in FIG. 4 comprises a single mesa and is a bottom view thereof. Those portions of FIG. 4 which comprise metallic conducting patterns for connecting the underlying semiconductor material are represented by cross hatching. Areas where the metallic conducting material actually contacts the underlying semiconductor material are shaded. The wafer material used in the preferred embodiment of the invention is N-type monocrystalline silicon.

Considering the schematic diagram of FIG. 3 along with its embodiment as illustrated in FIG. 4, the input signal is coupled to the network by means of conductive strip 50. The input logic signal is coupled thereby to one end of resistor 30 which comprises a P-type diffusion 52 in the bottom surface of the mesa. The other end of resistor 30 is contiguous with a second P-type diffusion 54 comprising the base of transistor 32. These two P-type regions are diffused simultaneously, thereby automatically providing the electrical contact between resistor 30 and the base of transistor 32. Additional P-type diffusions, also formed at this same step in fabrication, are shown at 56 and 58. P-type diffusion 56 provides the base region of heater transistor 38 while diffusion 58 comprises resistor 34.

Subsequent to the diffusion of the P-type material, a diffusion of N+ type material is made at various points in the mesa body. The first of these, shown at 60, provides the emitter for driver transistor 32. Electrical contact is made between the emitter diffusion 60 of transistor 32 and the base diffusion 56 of transistor 38 by means of conductive strip 62. Conductive strip 62 also couples the emitter of transistor 32 to one end of resistor 34 as provided by P-type diffusion 58. The other end of diffusion 58 is electrically coupled to ground plane 64. A second N+ diffusion 66 forms the emitter of heater transistor 38. Emitter diffusion 66 is connected directly to ground plane 64. The collectors of both transistors 32 and 38 as well as resistor 42 are provided by the bulk N type material of the mesa itself. The $V_{CC}$ supply voltage is provided to the network by conductive strip 68. Contact between conductive strip 68 and the bulk material comprising the two collectors and resistor 42 is made through a third N+ diffusion 70 formed simultaneously with emitter diffusions 60 and 66. The reason for the N+ doping in region 70 is to prevent the formation of a rectifying contact as might occur if the contact were made directly between the metallic conductor and the N type bulk material of the wafer.

Conductive strips 72, 74 and 76 serve to provide conductive paths through the region occupied by the mesa of FIG. 4 for the input signals of other mesas.

While the relative locations of the individual components in other mesas will vary slightly from that illustrated in FIG. 4, it will be understood that the configuration of FIG. 4 will be substantially duplicated in each of the mesas of the printhead structure.

Figure 5:
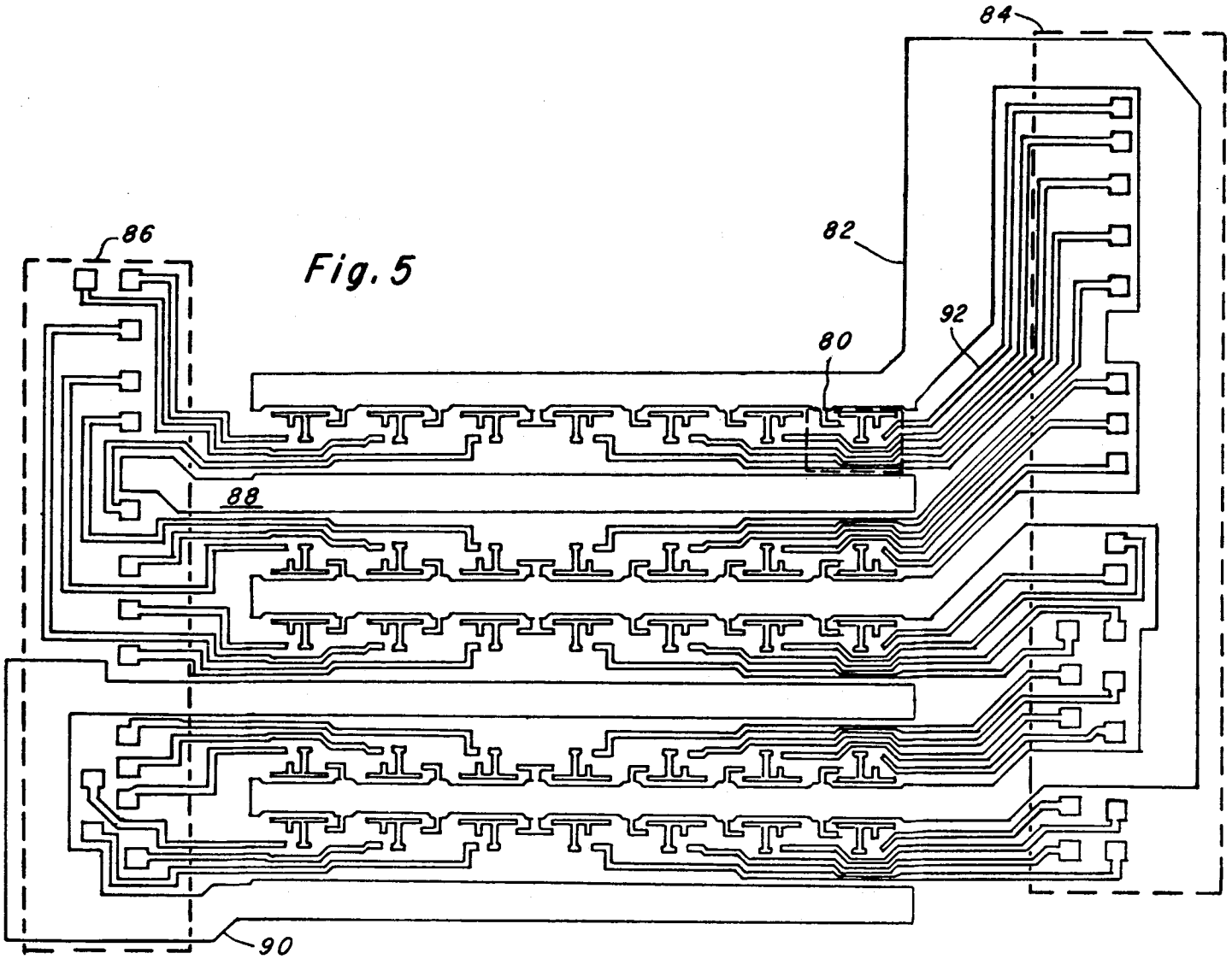
FIG. 5 shows the metalization pattern of a printhead.

In FIG. 5 there is illustrated the metallization pattern for one complete printhead. In FIG. 5 conductive strips such as those designated by reference designators 82, 88, 90 and 92 represent strips of conductive material such as aluminum or gold. The location of one of the mesas is indicated by dashed rectangle 80. It will be noted that the metallization pattern within dashed rectangle 80 corresponds closely with that shown in greater detail in FIG. 4. The positive voltage supply $V_{CC}$ is provided to all the mesas by means of conductive strip 82 which is seen to extend into a bonding pad region designated generally by dashed rectangle 84.

A second bonding pad region is shown generally within dashed rectangle 86. External connections to the printhead are made in these bonding pad regions through the underside of the substrate to which the mesas are secured. The ground connection for the 35 mesas is provided by conductive strips 88 and 90 both of which extend into bonding pad region 86. The input logic signal for mesa 80 is coupled from bonding pad region 84 by conductive strip 92. The pattern of FIG. 5 contains 35 such input logic signal conductors, one corresponding to each of the mesas in the 5×7 matrix. This permits independent control of the heating of each mesa.

Methods for fabricating structures such as the preferred embodiment of the present invention are well known in the art. One such method is disclosed in U.S. Pat. No. 3,769,562 to Kenneth E. Bean and assigned to the assignee of the present invention. This method will be briefly summarized here in connection with FIGS. 6*a* through *g*. As shown in FIG. 6*a* the mesas are formed in a wafer 100 of N-type monocrystalline silicon. The surface of silicon wafer 100 is oxidized to form a layer 102 of silicon dioxide. The oxide layer 102 is then selectively removed by the well known photolithographic process using photoresist material. Briefly, stated, this technique includes coating the oxidized surface with a thin layer of photoresist laquer 104. A photographic mask, opaque in those areas 106 from which the oxide layer 102 is to be removed, is positioned above the photoresist layer 104. After exposure of the photoresist by ultraviolet light, the photoresist underlying opaque areas 106 is removed by a solvent and, after baking to harden the remaining photoresist, the wafer 100 is immersed in a hydrofloric acid solution to etch away the silicon oxide and form in the silicon layer 102 two openings 108 and 110 (FIG. 6*b*).

Figure 6C:
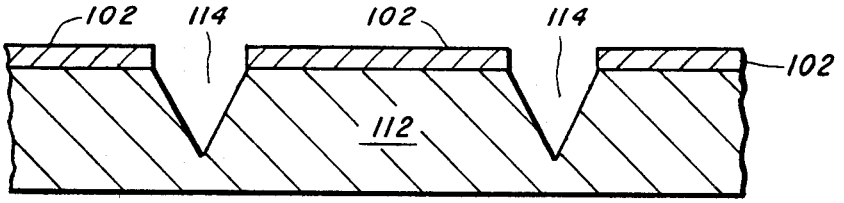
Figure 6D:
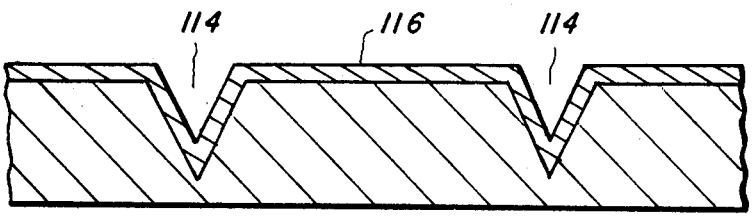

The masked wafer is then subjected to an orientation dependent etch solution to form therein V-shaped grooves or moats 114 which serve to define the mesas 112 (FIG. 6*c*). After the mesas are formed, the remaining photoresist material may be removed and the top surface of the slice is covered with a wear and silicon etch resistant coating 116 (FIG. 6*d*). The coating may be of a material such as silicon carbide, silicon nitride, silicon dioxide, or a combination thereof. It may be grown over silicon dioxide layer 102 (FIG. 6*b*) or directly on the wafer material after removal of layer 102.

After the cover layer 116 has been grown over the mesas 112 and moats 114, a layer 144 (FIG. 6*e*) of material, for example, polycrystalline semiconductor material, is deposited over the top surface of the slice 100 adjacent to the cover layer 116 to form a mechanically rigid structure. The most common method of deposition is by the hydrogen reduction of silicon tetrocholride, a technique well known in the art and requiring no elaboration here.

Figure 6E:
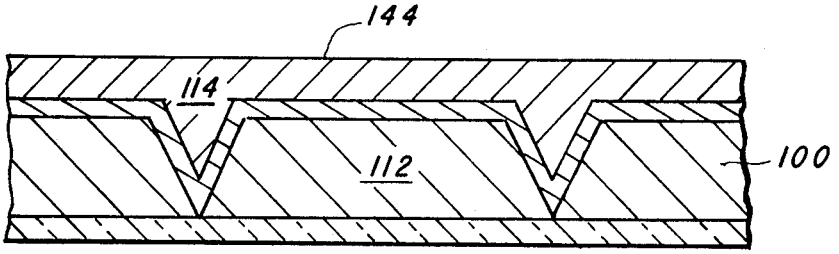

As the next step in the fabrication of the thermal printhead, the wafer 10 of FIG. 6*e* is subjected to a lapping and polishing treatment on its lower surface to remove all the original silicon material except that portion remaining within the mesas defined by the moats. The lapping and polishing treatment is continued until enough material has been removed from the lower surface of wafer 10 to visually expose the cover layer 116 at the bottom of the moats.

Figure 6F:
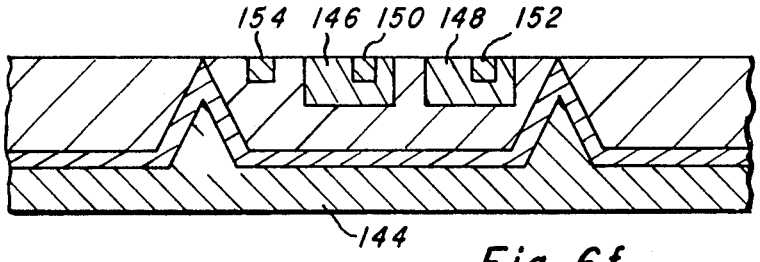

The next step is to invert the structure and, looking at what was the bottom or lower surface of the wafer 100 of FIG. 6*e* but will now be considered the top face of the unit, the structure appears as in FIG. 6*f*. Mesa regions 112 now serve as regions into which subsequent diffusions or implantations or upon which epitaxial depositions may be made in order to fabricate the circuit of each heating element. In the preferred embodiment of the present invention, diffusion processes are used for the circuit implementation and consideration of FIG. 4 will reveal that only two diffusions are required per printhead. It will be recalled that the wafer material in the preferred embodiment comprises N-type silicon. A diffusion of P-type silicon forms resistor 52 and transistor bases 54 and 56. This diffusion is shown in FIG. 6*f* at 146 and 148 respectively. A subsequent diffusion of N+ type silicon forms emitters 60 and 66 as well as the $V_{CC}$ contact 70. This diffusion is shown in FIG. 6*f* at 150, 152 and 154.

Figure 6G:
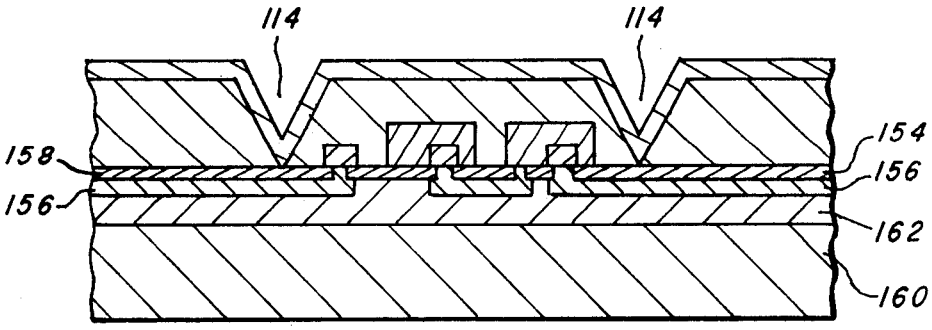

As seen in FIG. 6*g*, after the diffusions have been formed, the metallic conducting pattern of FIG. 5 is deposited on the printhead at the back side of the mesas. The metallic material 156 is insulated from the silicon of the mesas by a thin oxide insulating layer 158. Selectively located openings in oxide layer 158 permit the metallic material 156 to form ohmic contact with appropriately chosen portions of the diffusions. Techniques for forming the diffusions and the metallic connecting pattern are well known in the art and need no further description here.

Further, as seen in FIG. 6*g*, the array of mesas is then mounted upon, e.g., a ceramic substrate 160 with a suitable adhesive such as epoxy shown generally at 162. Finally, the polycrystalline layer is partially or completely removed resulting in the structure shown in FIG. 6*g* whereby the mesa thermal printing elements are isolated from each other by the dielectric layer of, for example, silicon carbide, silicon nitride, or silicon dioxide and any polycrystalline silicon remaining in the moats 114.

While not expressly in FIG. 6*g*, openings are formed in the substrate material 160 in the region of the bonding pad areas 84 and 86 as shown in FIG. 5. These openings will be similar to the openings 6 of the prior art structure as illustrated in FIG. 1*b*. Electrical connections to external circuitry are made by means of wires brought in through these openings from the bottom side of the printhead structure and connected to the various bonding pads.

Operationally, the mesas of the preferred embodiment when energized so as to form a hot spot, are designed to operate at approximately 200°C. At this temperature the behavior of the various junctions in the mesa structure is significantly different than at lesser operating temperatures and the entire structure of FIG. 3 may begin to function as a resistor connected between $V_{CC}$ and ground. Under these conditions attempts to turn off the heater transistor 38 by reducing the input logic potential to a low level may prove ineffectual. To insure reliable operation, the input logic signal is used only as a turn-on signal. When a character is to be formed, the supply voltage $V_{CC}$ is applied to all of the mesas of the printhead. Then, the input signals corresponding to those mesas which are to be heated in the formation of the character are switched to a high logic level. After the character has been formed the input signals may all be switched to a low logic level and the supply voltage $V_{cc}$ is removed from all mesas, thereby insuring that all mesas are turned off in preparation for formation of the next character.

There has been disclosed a unique thermal printhead comprised of mesas in each of which there is located a driver as well as a heater transistor. As a result, all substantial heat generating elements of the printhead are located within the mesas themselves and the printhead can be driven directly from TTL or MOS type logic circuitry without the intervention of impedance matching circuits. Although a detailed description of a preferred embodiment of the invention has been described, it will be apparent to a person skilled in the art that various modifications to the details of construction shown and described may be made without departing from the scope of this invention.

What is claimed is

1. A thermal printhead comprising a plurality of mesas arranged on a substrate, each of said mesas containing heat dissipative semiconductor means for operation in either a quiescent or a heat dissipating state and switchable from said quiescent to said heat dissipating state in response to input signal to the mesa of amplitude as low as 0.4 milliamperes.

2. A thermal printhead comprising a plurality of mesas arranged on a substrate, each of said mesas containing heat dissipative semiconductor means operable in either a heat dissipating or a quiescent state and switchable from said quiescent to said dissipating state in response to changes in the level of a control signal, and each of said mesas further containing matching network means responsive to at least one mesa input signal for providing said control signal.

3. A thermal printhead comprising:

a. a substrate; and b. a semiconductor wafer mounted on said substrate, a portion of said semiconductor wafer being divided into air isolated mesas and each of said mesas containing heat dissipative means comprised of at least two transistors operably connected to generate a hot-spot at the face of the mesa in response to an input signal.

4. The thermal printhead of claim 3 wherein the current gain of said heat dissipative means is sufficiently high to ensure generation of said hot-spot when the current drive provided by said input signal reaches a level not in excess of 0.4 milliamperes.

5. The thermal printhead of claim 3 wherein said heat dissipative means comprises a heater transistor stage for dissipating sufficient electrical energy to provide said hot-spot and a driver transistor stage operably responsive to said input signal for driving said heater transistor stage.

6. The thermal printhead of claim 5 wherein said driver transistor stage is emitter coupled to the base of said heater transistor stage and the collector of said driver transistor stage is coupled to an intermediate point along the collector resistor of said heater transistor stage.

7. A thermal printhead comprising:

a. a substrate;

b. an array of monocrystalline semiconductor bodies physically separated from each other and mounted on one surface of said substrate by an insulating adhesive, c. heater elements respectively in said monocrystalline semiconductor bodies each comprising a driver transistor operably connected to a heater transistor; and d. a conductive pattern located in said insulating adhesive between said monocrystalline semiconductor bodies and said one surface of said substrate for providing power and logic control signals to said heater elements.

* * * * *